US011458756B2

(12) United States Patent
Öz

(10) Patent No.: US 11,458,756 B2
(45) Date of Patent: Oct. 4, 2022

(54) TRANSFER PAPER FOR TRANSFERRING IMAGES TO SUBSTRATES

(71) Applicant: FOREVER GMBH, Heddesheim (DE)

(72) Inventor: Bülent Öz

( * ) Notice: Subject to any disclaimer, the term of this patent is extended or adjusted under 35 U.S.C. 154(b) by 0 days.

(21) Appl. No.: 17/284,007

(22) PCT Filed: Oct. 10, 2019

(86) PCT No.: PCT/EP2019/077522
§ 371 (c)(1),
(2) Date: Apr. 9, 2021

(87) PCT Pub. No.: WO2020/074663
PCT Pub. Date: Apr. 16, 2020

(65) Prior Publication Data

US 2021/0379918 A1 Dec. 9, 2021

(30) Foreign Application Priority Data

Oct. 11, 2018 (DE) ..... 10 2018 125 221.8

(51) Int. Cl.
*B41M 5/00* (2006.01)
*B41M 5/025* (2006.01)
*B41M 5/52* (2006.01)

(52) U.S. Cl.
CPC ..... *B41M 5/0256* (2013.01); *B41M 5/5254* (2013.01)

(58) Field of Classification Search
CPC ..... B41M 5/0256; B41M 5/5254
USPC ..... 428/32.6
See application file for complete search history.

(56) References Cited

U.S. PATENT DOCUMENTS

2002/0195005 A1* 12/2002 Oshima ..... B41M 5/0256 101/33
2003/0021962 A1 1/2003 Mukherjee et al.
2003/0219575 A1 11/2003 Mets
2011/0162789 A1 7/2011 Lee
2015/0122139 A1* 5/2015 Oz ..... B41F 17/24 101/483
2021/0379918 A1* 12/2021 Oz ..... B41M 5/03

FOREIGN PATENT DOCUMENTS

WO WO 2013/159922 A1 10/2013

OTHER PUBLICATIONS

International Search Report, PCT/EP2019/077522, dated Jan. 28, 2020, 2 pgs.

* cited by examiner

*Primary Examiner* — Betelhem Shewareged
(74) *Attorney, Agent, or Firm* — Paul D. Strain, Esq.; Strain PLLC

(57) ABSTRACT

The invention relates to a transfer paper for transferring images onto substrates, comprising a carrier having a wax coating; a layer (A) arranged thereon, containing a wax emulsion, a binding agent, an inorganic crystalline substance, and a pigment; a layer (B) arranged on layer (A), containing an organic polymer, an inorganic crystalline substance, a fixing agent, a copolymer and a pigment; and a layer (C) arranged on layer (B), containing an organic polymer, a binding agent, an inorganic crystalline substance, a wax emulsion, a copolymer and a pigment. The invention also relates to a method for transferring images onto substrates using the transfer paper.

18 Claims, No Drawings

TRANSFER PAPER FOR TRANSFERRING IMAGES TO SUBSTRATES

CROSS-REFERENCE TO RELATED PATENT APPLICATIONS

This application is a National Stage of International Application No. PCT/EP2019/077522, filed Oct. 10, 2019, which is based upon and claims the benefit of priority from prior German Patent Application No. 10 2018 125 221.8, filed Oct. 11, 2018, the entire contents of all of which are incorporated herein by reference in their entirety.

The present invention relates to a system for transferring images onto substrates (transfer printing), such as textile substrates, in particular T-shirts. The invention also relates to a corresponding method for transferring images onto solid materials.

During transfer printing, i.e. the transfer of images onto substrates, such as textile bases, with the aid of so-called transfer papers, onto which the image to be transferred is applied in advance, under elevated pressure and temperature conditions, an undesired background transfer often occurs, namely the transfer of parts of the coating of the transfer paper which are not part of the image.

To prevent this, additional steps, such as contour cutting on the transfer paper and subsequent weeding are necessary and/or different temperatures must be used during preparation of the transfer paper and during the actual transfer process.

Particularly with dark substrates, such as dark-coloured or black textiles, the colourfulness of the transferred image, in particular the vividness and brilliance of the colours, is not satisfactory when using the single-sheet systems available on the market, which are generally produced for light-coloured textiles.

Another criterion is the wash resistance of the transferred image on the substrate, which is often not satisfactory.

The currently known solutions for transfer without background on "dark-coloured and black" substrates and fabrics with a correspondingly good vividness, brilliance of the colours and good wash resistance are currently limited exclusively to so-called two-sheet systems.

A two-sheet system for transferring images onto substrates is known, wherein a printable carrier (component A) comprises the image in the form of an at least partial area toner layer, and a component B comprises a carrier and a polymer layer applied thereto and a further opaque layer (WO 2013/159922 A1). This system is a "self-weeding" system, wherein substantially only the printed areas are transferred onto the substrate without the need for contour cutting and weeding. However, it is disadvantageous that two different sheets must be used, and the transfer process requires two steps under elevated temperature and pressure conditions, as well as an additional separation step of components A and B.

The application of the image to the carrier material/transfer paper is thereby advantageously carried out by means of digital printing, laser printing, in particular by means of (colour) copiers or (colour) laser printers, inkjet printers, wherein commercial inks or toners are used.

The present invention has therefore set itself the object of providing a simplified system and method for transferring images onto substrates that overcomes the above-mentioned disadvantages.

The present invention therefore relates to a transfer paper for transferring images onto substrates, comprising a carrier having one or more wax coatings; a layer (A) disposed thereon containing a wax emulsion, a binding agent, an inorganic crystalline substance and a pigment; a layer (B) arranged on the layer (A), containing an organic polymer, in particular a polydiallyldimethylammonium chloride, a binding agent, a fixing agent, a copolymer, and a pigment; a layer (C) arranged on the layer (B) containing an organic polymer, in particular a polydiallyldimethylammonium chloride, a wax emulsion, a copolymer, an inorganic crystalline substance, and a pigment.

The present invention provides a one-sheet solution for light-coloured and especially dark-coloured, as well as black substrates, in particular dark-coloured and black textiles, fabrics and solid materials.

The invention provides a so-called self-weeding one-sheet system, wherein the transfer paper is printed with an image to be transferred, the printed transfer paper is arranged with the printed side on a substrate, the substrate with the transfer paper arranged thereon is subjected to the effect of pressure and temperature, e.g. by means of a thermal transfer press or an iron, the transfer paper is peeled off the substrate in such a way that the non-printed areas remain on the carrier of the paper and the printed areas, i.e. the image, remain on the substrate. The peeling of the substrate occurs in a warm or hot state (so-called "warm peel" or "hot peel"). In the warm state means that peeling takes place after a waiting time following the transfer process. The waiting time is typically up to approximately 15 seconds. In the hot state means that peeling takes place directly after the transfer process. The peeling/separating thus takes place substantially in the range of the temperature of the pressing operation or somewhat lower, in particular above room temperature.

The present invention is particularly suitable for transferring images onto dark substrates, such as dark or black textiles.

The application of the image onto the transfer paper is carried out by means of conventional printing methods, advantageously by means of digital printing, laser printing, in particular by means of (colour) copiers or (colour) laser printers, inkjet printers, wherein commercial inks or toners are advantageously used.

Water-soluble or solvent-containing inks, sublimation inks, polymeric dyes, so-called flexographic dyes, screen printing dyes, offset dyes or similar can be considered as inks in the sense of the present invention. Preferably, sublimation inks are used for applying the image onto the transfer paper.

Toners consist of the corresponding colour pigments in a plastic matrix, usually polyester with a melting range of e.g. approximately 80-120° C., and possibly auxiliaries. The thickness of the toner layer is within the usual technical values and is typically 5-50, preferably 5-20 g/m2 (in grammage).

Carriers for transfer papers are inherently known and can be selected from non-woven fabrics, in particular based on cellulose fibres, such as coated or uncoated paper or cardboard, or from plastic films. The carrier is, for example, a film, cardboard or paper, in particular a paper having a grammage of, for example, around 80-150, preferably around 90-100 g/m2, such as a machine-smooth paper suitable for (colour) copiers, (colour) laser printers or ink-jet printers.

At least one surface of said carrier or paper is provided with a polymer coating (hereinafter also referred to as wax layer) of polyolefins, polyolefin copolymers or polyurethanes having a layer thickness of around 20-60, preferably around 25-50 g/m2.

The polyolefins used are, for example, LDPE optionally with maleic anhydride, EVA with approximately 7-28%, preferably approximately 7-15% VA content, ethylene acrylic acid copolymers or ethylene methyl acrylate copolymers with approximately 5-12% acrylic acid, ethylene butyl acrylate copolymers with approximately 5-20% are used, which preferably have a melt index according to ASTM-D-1238 (MFI) of approximately 3.5-22, preferably approximately 7-15 g/10 min at 2.16 g/190° C.

Preferably, the coating contains waxes. Waxes to be considered are, for example, paraffins or paraffin waxes, or even mixtures of paraffin waxes with LDPE. The waxes typically have melting points in the range of around 60-100° C. In particular, a wax layer can additionally be arranged between the carrier surface and the extrusion layer, said wax layer typically having a layer thickness of, for example, approximately 10-20 g/m2.

The wax layer can be single or multilayer. Preferably, the wax layer is multi-layered.

Processes for changing the surface structure of the carrier, e.g. by treating the surface by means of profile rollers or similar, are also familiar to the person skilled in the art.

To improve the wettability of the surface and the adhesion of the inks or toners, the surface of the carrier can optionally be subjected to a further surface treatment to increase the surface tension, in particular a plasma or corona treatment is carried out according to the invention.

A layer (A) is arranged on the wax coating of the carrier, which comprises the following constituents (percentages refer to % by weight based on the total weight of the layer):

a wax emulsion, in particular based on polyethylene wax. The proportion of wax emulsion is typically around 15-40%, in particular around 20-30%, a polyurethane-based binding agent for elasticity. The proportion of the binding agent is typically around 40-70%, in particular around 40-60%, an inorganic crystalline substance, such as silica in particular, but also calcium carbonate or bentonite. The proportion of the inorganic crystalline substance is typically around 5-35%, in particular around 10-25%, a pigment, advantageously in an acrylate-based binding agent. The proportion of the pigment is typically around 15-40%, in particular around 20-35%.

The pigment is organic and/or inorganic and selected from white pigment, colour pigments, glitter, metallic pigments, functional pigments or mixtures thereof. By way of example, the pigment can be selected from multiple colour pigments.

The structure of the white pigment preferably contains around 25-75% of a white pigment, for example titanium dioxide, chalk, barium sulphate, zinc sulphide, zinc sulphate or kaolin, preferably titanium dioxide, around 25-75% of a plastic binding agent, which may be a polyolefin, polyolefin copolymer or polyurethane, wherein reference is made to the above list of possible substances. Alternatively, a colour pigment or functional pigment can be used.

Functional pigments are to be understood as pigments having reflective, phosphorescent, fluorescent, photoluminescent or similar optical properties.

The layer thickness of the A-layer is around 2-15 g/m2, preferably around 4-10 g/m2, in particular around 2-6 g/m2, especially around 7-15 g/m2.

The A-layer advantageously has glass transition or softening temperatures in the range of around 130-200° C.

Functionally, the layer (A) substantially serves to provide the base colour. This comes into effect in particular when one or more colour pigments are included. Particularly in the case of monochromatic images, the layer (A) then serves to provide the base colour of the image.

A layer (B) is arranged on the layer (A) and comprises the following substances (percentages refer to % by weight based on the total weight of the layer):

an organic polymer, in particular based on diallylmethylammonium chloride (polydiallylmethylammonium chloride), which serves in particular to bind the colour pigments. The proportion of the organic polymer is typically around 5-30%, in particular around 10-25%;

a binding agent, in particular polyurethane-based, for elasticity. The proportion of binding agent is typically around 5-30%, in particular around 10-25%;

a fixing agent, in particular polyurethane-based, for improving wash resistance. The proportion of fixing agent is typically around 1-20%, in particular around 5-15%; a copolymer, in particular based on vinyl acetate and ethylene, for absorbing the ink and drying it. The proportion of copolymer is typically around 10-35%, in particular around 15-30%.

a pigment, in particular in an acrylate-based binding agent. The proportion of organic or inorganic pigment is typically around 25-50%, in particular around 30-45%.

Optionally, additives such as an inorganic crystalline substance, e.g. silica or cellulose ester or other known processing aids can be added. Preferably in a proportion of around 5-35%, preferably 10-30%.

Other components which can be included are: a plastic, particularly suitable are polyester, polyurethane, polyacrylate and other compounds, for example homopolymers or copolymers of vinyl acetate, vinyl alcohol, vinyl chloride, vinylidene chloride, methyl and/or ethyl acrylic acid or methacrylic acid, maleic acid compounds, styrene and others.

Also suitable are cellulose esters and cellulose ethers such as ethyl cellulose, benzyl cellulose, cellulose propionates or acetates or butyrates or even polyesters of terephthalic acid or polyamides such as nylon or perlon.

The pigment is organic and/or inorganic and selected from white pigment, coloured pigments, glitter, metallic pigments, functional pigments or mixtures thereof. By way of example, the pigment can be selected from several colour pigments.

The layer thickness of the B-layer is around 5-20 g/m2, preferably around 10-15 g/m2, in particular approximately 5-12 g/m2, particularly approximately 13-20 g/m2.

Advantageously, the B-layer has glass transition or softening temperatures in the range of around 130-200° C.

Functionally, the layer (B) substantially serves to absorb the ink, in particular the colour particles after sublimation of the ink, and to improve the wash resistance and elasticity of the image on the substrate.

Another function of the layer (B) is good adhesion to the layer (A).

A layer (C) is arranged on the layer (B) and comprises the following substances (percentages refer to % by weight based on the total weight of the layer):

an organic polymer, in particular based on diallylmethylammonium chloride, which serves in particular to bind the colour pigments. The proportion of the organic polymer is typically around 10-40%, in particular around 15-30%;

a wax emulsion, in particular polyurethane-based. The proportion of the wax emulsion is typically around 15-40%, in particular around 20-35%;

a copolymer, in particular based on vinyl acetate and ethylene, for absorbing the toner or the ink and drying it. The proportion of copolymer is typically around 15-40%, in particular around 20-35%;

an inorganic crystalline substance, such as silica in particular, but also calcium carbonate or bentonite. The proportion of the inorganic crystalline substance is typically around 5-30%, in particular around 10-25%;

a pigment, in particular in an acrylate-based binding agent. The proportion of pigment is typically around 10-35%, in particular around 15-30%.

The pigment is organic and/or inorganic and selected from white pigment, coloured pigments, glitter, metallic pigments, functional pigments or mixtures thereof. By way of example, the pigment can be selected from several colour pigments. Advantageously, the pigment is a white pigment.

The layer thickness of the C-layer is around 5-20 g/m2, preferably around 10-15 g/m2, in particular around 5-12 g/m2, particularly around 13-20 g/m2.

Advantageously, the C-layer has glass transition or softening temperatures in the range of around 130-200° C.

The layer (C) is the printable layer onto which the image is applied. Functionally, it substantially serves to absorb the ink, in particular the colour particles after the sublimation of the ink, and to adhere to the substrate.

Further functions of layer (C) are good adhesion to layer (B) and coverage of the substrate colour.

In the case of monochromatic images, the pigments of the layer (A) are preferably selected from colour pigments and thus provide the base colour of the image. Advantageously, the pigments of layers (A) and (B) are selected from colour pigments of the same colour. By specifying the base colour of the image, the colour of the ink is of secondary importance in this case. A transparent ink or toner could even be used.

The pigment of layer (C) is preferably a white pigment. This serves a basic coverage of the colour of the substrate. Furthermore, a metallic pigment can also be added for better coverage of the substrate surface.

In the case of coloured images, the pigments of layers (A), (B) and (C) are preferably selected from white pigments. The ink, in particular the colour particles after sublimation of the ink, penetrate all layers (A)-(C) and produce a coloured image on the substrate.

In accordance with the invention, it is provided that further optional layers may be present. It is thus possible that, for example, instead of one layer (B), there are also two layers (B), or instead of one layer (C), there are also two layers (C). Advantageously, in this case the two layers (B) or (C) each have a smaller layer thickness on their own than in the case of the presence of only one layer (B) or (C).

Also possible is the presence of an optional layer (D), e.g. a metallic layer of metallic pigments, which is arranged above the layer (C) and thus then represents the outermost layer of the transfer paper.

During production, the respective layers are preferably applied to the carrier separately one after the other, in particular with sufficient drying times.

The layers (A), (B) and (C), and possibly other optional layers, can be formulated in such a way that they are activated by an alcoholic-aqueous fluid, such as the liquid phase of the ink, or by a melting toner under elevated pressure and temperature, but the layer structures are substantially preserved.

Without being bound to one theory, it is assumed that the process of self-weeding of the printed transfer paper is caused by the respective outermost layer of the transfer paper, typically the layer (C), becoming tacky due to interaction with the toner or ink under pressure and temperature. Under these conditions, a melting toner or the solvent-containing medium of an ink will at least partially dissolve the layer (C), causing it to become tacky to the substrate surface.

The layer (C) adheres to the substrate surface. The formulation of the layers causes a certain brittleness in heat in the printed area, such that when the carrier (carrier paper) is peeled off, a kind of vertical break occurs in the sequence of layers (i.e. from layer (C) towards layer (B), layer (A) and possibly the wax layer) along the printed area, and thus layers (B) and (A) and possibly parts of the wax layer are held on the substrate by the layer (C), while in the unprinted area there is no adhesion to the substrate.

The present invention also relates to the use of the transfer paper according to the invention.

Another subject matter of the present invention is a method for transferring images onto a substrate using the transfer paper according to the invention.

The method for transferring images onto substrates according to the invention comprises providing a transfer paper according to the invention;

applying the image onto the layer (C) by means of a printing process, advantageously by means of digital printing, wherein printed and non-printed areas are defined on the layer (C);

applying the transfer paper onto a substrate with the printed side (layer (C)) facing the surface of the substrate;

subsequently pressing the arrangement of substrate and transfer paper at around 2-5 bar in the temperature range from a minimum of around 100-150° C. to a maximum of around 200-250° C., for example from around 100-250° C., in particular from around 150° C. to a maximum of around 200-250° C., in particular from around 150-220° C., particularly from around 150-200° C., also 180-220° C., typically for a minimum of around 15-20 seconds to a maximum of around 60 seconds, in particular around 15-45 seconds, preferably 15-30 seconds, wherein the image is transferred onto the substrate; and separating the carrier of the carrier paper in the warm or hot state.

The method according to the invention can be carried out with conventional devices, so-called transfer presses.

According to one embodiment of the invention, after transfer of the image to the substrate, an additional treatment of the image takes place. Preferably, a so-called finishing is carried out, in particular by applying a finishing foil, such as hot stamping foil or flock sheet. The use of corresponding foils in the field of transfer printing is familiar to persons skilled in the art (https://www.forever-ots.de/produkt/hot-stamping-foils/; https://www.plottermarie.de/folien/825-veredelungsfolien-meterware.html; https://www.printequipment.de/heisspraege/; https://lfp-partner.eu/datenblatt/forever/HSF-Anleitung-DE.pdf; https://www.forevertransferpaper.com/no-cut-flock-sheets).

The hot stamping foil is usually applied at temperatures in the range of around 150 to 200° C. and medium to high pressures of around 3 to 6 bar, preferably high pressures of around 5 bar for around 10 to 120 seconds, preferably around 25 to 45 seconds. The hot stamping foil is usually peeled off in the cold state.

The invention therefore also relates to a combination of the transfer paper according to the invention with a finishing foil. The combination can exist in spatially separated form or in a common package.

Unless otherwise indicated or necessarily indicated by the context, the percentages refer to the weight, in case of doubt to the total weight, of the mixture.

The invention also relates to all combinations of preferred embodiments, insofar as these are not mutually exclusive. The indications "approximately" or "around" in connection with a numerical indication mean that at least values higher or lower by 10% or higher or lower by 5% are included, and in any case values higher or lower by 1% are included. If an indefinite article such as "a" or "an" has been used above in reference to a term, this also includes the meaning "one or more" or "at least one".

The invention claimed is:

1. A transfer paper for transferring images onto substrates, comprising a carrier having a wax coating;

(A) a layer arranged thereon, containing a wax emulsion, a binding agent, an inorganic crystalline substance, and a pigment;

(B) a layer arranged on layer (A), containing an organic polymer, a binding agent, a fixing agent, a copolymer and a pigment;

(C) a layer arranged on layer (B), containing an organic polymer, a binding agent, an inorganic crystalline substance, a wax emulsion, a copolymer and a pigment.

2. The transfer paper according to claim 1, wherein the carrier is selected from paper, foil or cardboard.

3. The transfer paper according to claim 1, wherein the pigment is selected from white pigment, colour pigments, glitter, metallic pigments, functional pigments or mixtures thereof.

4. The transfer paper according to claim 3, wherein the pigment in layer (A) is a white pigment or one or more colour pigments.

5. The transfer paper according to claim 1, wherein the organic polymer in layer (B) and/or (C) is a polydiallyldimethylammonium chloride.

6. The transfer paper according to claim 1, wherein layer (B) additionally contains an inorganic crystalline substance.

7. A method for transferring images onto substrates, comprising providing a transfer paper according to claim 1;

applying an image onto the layer (C) by means of a printing process, wherein printed and non-printed areas are defined on the layer (C);

applying the transfer paper onto a substrate with the printed side (layer (C)) facing the surface of the substrate;

subsequently pressing the arrangement of substrate and transfer paper at around 2-5 bar in the temperature range from a minimum of around 100-150° C. to a maximum of around 200-250° C., for a minimum of around 15-20 seconds to a maximum of around 60 seconds, wherein the image is transferred onto the substrate; and separating the carrier of the transfer paper in the warm or hot state.

8. A method for transferring images onto substrates, comprising providing a transfer paper according to claim 1; and using the transfer paper to transfer an image onto a substrate.

9. The method according to claim 8, wherein the substrate is a dark coloured or black textile.

10. The transfer paper according to claim 1, wherein the inorganic crystalline substance in layer (A) and/or layer (C) is selected from silica, calcium carbonate, and bentonite.

11. The transfer paper according to claim 1, wherein the organic polymer in layer (B) and/or layer (C) is based on diallylmethylammonium chloride.

12. The method according to claim 7, wherein the pressing occurs in a temperature range from around 100-250° C.

13. The method according to claim 12, wherein the pressing occurs in a temperature range from around 150° C. to a maximum of around 200-250° C.

14. The method according to claim 13, wherein the pressing occurs in a temperature range from around 150-220° C.

15. The method according to claim 14, wherein the pressing occurs in a temperature range from around 150-200° C.

16. The method according to claim 14, wherein the pressing occurs in a temperature range from around 180-220° C.

17. The method according to claim 7, wherein the pressing occurs for around 15-45 seconds.

18. The method according to claim 17, wherein the pressing occurs for around 15-30 seconds.

* * * * *